US008881901B2

(12) United States Patent
Harrelson

(10) Patent No.: US 8,881,901 B2
(45) **Date of Patent: *Nov. 11, 2014**

(54) DISPENSING SYSTEM FOR DOUBLE STACK CARTON

(71) Applicant: Graphic Packing International, Inc., Atlanta, GA (US)

(72) Inventor: Glen R. Harrelson, Navarre, FL (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/854,209

(22) Filed: Apr. 1, 2013

(65) Prior Publication Data

US 2013/0213991 A1 Aug. 22, 2013

Related U.S. Application Data

(63) Continuation of application No. 13/455,259, filed on Apr. 25, 2012, now Pat. No. 8,408,392, which is a (Continued)

(51) Int. Cl.
*B65D 75/00* (2006.01)
*B65D 17/00* (2006.01)

(Continued)

(52) U.S. Cl.
CPC ..... *B65D 71/34* (2013.01); *B65D 5/541* (2013.01); *B65D 71/36* (2013.01); *B65D 2571/00401* (2013.01); *B65D 2571/0066* (2013.01); *B65D 5/725* (2013.01); *B65D 2571/00574* (2013.01); *B65D 2571/0045* (2013.01)
USPC ..... 206/427; 221/305; 229/122; 229/242

(58) Field of Classification Search
USPC ..... 206/427–429; 221/303, 305–309; 229/121–122, 240, 242
See application file for complete search history.

(56) References Cited

U.S. PATENT DOCUMENTS 902,347 A 10/1908 Tillinghast
1,497,536 A 6/1924 Billstein (Continued)

FOREIGN PATENT DOCUMENTS

CA 874828 6/1971
CA 2 246 020 2/2000

(Continued)

OTHER PUBLICATIONS

*Graphic Packaging International, Inc.* v. *C.W. Zumbiel Co.* (M.D. FL), Civil Action No. 3:10-cv-00891-UATC-JBT, Defendant C.W. Zumbiel Co.'s Motion in Limine and Incorporated Memorandum of Law, Dec. 13, 2011.

(Continued)

*Primary Examiner* — Bryon Gehman
(74) *Attorney, Agent, or Firm* — Womble Carlyle Sandridge & Rice, LLP

(57) ABSTRACT

The carton of this invention is capable of carrying the plurality of containers stacked upon their ends in two tiers with a unique dispenser that permits the dispensing of containers on their sides. The dispenser is formed in a top side wall and extends into the end wall with most of the end wall being torn open but leaving a portion near the bottom side wall to prevent the bottom layer of containers from rolling out. Angled projections in the dispensing end of the carton near the top panel and bottom panel prevent the top layer of containers from rolling out. A divider may be inserted between the two tiers of containers to facilitate loading the carton and preventing the containers from accidentally rolling out when the dispenser is open.

26 Claims, 4 Drawing Sheets

Related U.S. Application Data continuation of application No. 13/052,489, filed on Mar. 21, 2011, now Pat. No. 8,181,782, which is a continuation of application No. 12/752,586, filed on Apr. 1, 2010, now Pat. No. 8,127,924, which is a continuation of application No. 12/274,477, filed on Nov. 20, 2008, now Pat. No. 7,780,003, which is a continuation of application No. 11/558,717, filed on Nov. 10, 2006, now Pat. No. 7,467,713, which is a continuation of application No. 11/139,827, filed on May 27, 2005, now Pat. No. 7,134,551, which is a continuation of application No. 10/365,148, filed on Feb. 12, 2003, now Pat. No. 6,918,487.

(51) Int. Cl.

| | |
|---|---|
| ***A47F 1/04*** | (2006.01) |
| ***B65D 5/54*** | (2006.01) |
| ***B65D 71/36*** | (2006.01) |
| ***B65D 71/34*** | (2006.01) |
| ***B65D 5/72*** | (2006.01) |

(56) References Cited

U.S. PATENT DOCUMENTS

| | | | |
|---|---|---|---|
| 1,541,143 | A | 6/1925 | Hoile |
| 1,609,186 | A | 11/1926 | Peruzzi |
| 1,853,219 | A | 4/1932 | Newton |
| 1,925,102 | A | 9/1933 | Levkoff |
| 2,026,477 | A | 12/1935 | Lescher |
| 2,067,749 | A | 1/1937 | Zimmerman et al. |
| 2,115,673 | A | 4/1938 | Stompe |
| 2,278,793 | A | 4/1942 | Myers |
| 2,294,965 | A | 9/1942 | Davidson |
| 2,316,796 | A | 4/1943 | Lichter |
| 2,448,819 | A | 9/1948 | Mitchell |
| 2,473,635 | A | 6/1949 | Buttery |
| 2,619,226 | A | 11/1952 | Adams |
| 2,718,301 | A | 9/1955 | Palmer |
| 2,723,027 | A | 11/1955 | Guyer |
| 2,754,047 | A | 7/1956 | Schmidt et al. |
| 2,842,304 | A | 7/1958 | Ringler |
| 2,844,298 | A | 7/1958 | Tamarin |
| 2,868,431 | A | 1/1959 | Painter |
| 2,930,516 | A | 3/1960 | Fowle et al. |
| 2,975,891 | A | 3/1961 | Stone |
| 2,990,097 | A | 6/1961 | Thompson |
| 3,002,651 | A | 10/1961 | Gauld |
| 3,018,031 | A | 1/1962 | Ahlbor et al. |
| 3,178,242 | A | 4/1965 | Ellis et al. |
| 3,228,582 | A | 1/1966 | Osberg |
| 3,263,861 | A | 8/1966 | Carr |
| 3,265,283 | A | 8/1966 | Farquhar |
| RE26,083 | E | 9/1966 | Forrer |
| 3,270,941 | A | 9/1966 | Barnes |
| 3,300,115 | A | 1/1967 | Schauer |
| 3,332,594 | A | 7/1967 | Capua |
| 3,356,279 | A | 12/1967 | Root |
| 3,416,719 | A | 12/1968 | Pilger |
| 3,517,858 | A | 6/1970 | Farquhar |
| 3,540,581 | A | 11/1970 | Koolnis |
| 3,599,858 | A | 8/1971 | Samsing |
| 3,602,392 | A | 8/1971 | Cote |
| 3,669,251 | A | 6/1972 | Phillips, Jr. |
| 3,696,990 | A | 10/1972 | Dewhurst |
| 3,765,327 | A | 10/1973 | Aronson et al. |
| 3,765,527 | A | 10/1973 | Vargo |
| 3,784,022 | A | 1/1974 | Beesley, Jr. |
| 3,894,681 | A | 7/1975 | Arneson et al. |
| 3,913,739 | A | 10/1975 | Hennessey |
| 3,942,631 | A | 3/1976 | Sutherland et al. |
| 3,952,872 | A | 4/1976 | Consiglio, Jr. |
| 3,961,706 | A | 6/1976 | Roccaforte et al. |
| 4,000,811 | A | 1/1977 | Hardison et al. |
| D243,508 | S | 3/1977 | Killy |
| 4,030,596 | A | 6/1977 | Snyder et al. |
| D252,259 | S | 7/1979 | Rinehart |
| 4,214,660 | A | 7/1980 | Hunt, Jr. |
| 4,216,861 | A | 8/1980 | Oliff |
| 4,222,485 | A | 9/1980 | Focke |
| 4,252,236 | A | 2/1981 | Roccaforte |
| D263,204 | S | 3/1982 | Dutcher |
| 4,318,474 | A | 3/1982 | Hasegawa |
| 4,325,482 | A | 4/1982 | Feeser |
| 4,331,289 | A | 5/1982 | Killy |
| 4,334,644 | A | 6/1982 | Hauser |
| 4,340,170 | A | 7/1982 | Montealegre |
| 4,364,509 | A | 12/1982 | Holley, Jr. et al. |
| 4,375,258 | A | 3/1983 | Crayne et al. |
| 4,378,877 | A | 4/1983 | Botterman et al. |
| D269,068 | S | 5/1983 | Mann, Sr. et al. |
| D270,041 | S | 8/1983 | Vestal |
| 4,396,143 | A | 8/1983 | Killy |
| 4,405,078 | A | 9/1983 | Dutcher et al. |
| 4,416,410 | A | 11/1983 | Herrmann |
| 4,417,655 | A | 11/1983 | Forbes, Jr. |
| 4,417,661 | A | 11/1983 | Roccaforte |
| 4,466,536 | A | 8/1984 | Zeitel |
| 4,498,581 | A | 2/1985 | Dutcher |
| 4,558,816 | A | 12/1985 | Wood |
| 4,560,062 | A | 12/1985 | Valiulis |
| 4,577,762 | A | 3/1986 | Kuchenbecker |
| 4,577,799 | A | 3/1986 | Oliff |
| 4,582,199 | A | 4/1986 | Schuster |
| 4,588,084 | A | 5/1986 | Holley, Jr. |
| 4,605,128 | A | 8/1986 | Rieke |
| D286,987 | S | 12/1986 | Golan et al. |
| 4,726,471 | A | 2/1988 | Whately et al. |
| 4,785,991 | A | 11/1988 | Schuster |
| 4,805,800 | A | 2/1989 | Nocek et al. |
| 4,817,866 | A | 4/1989 | Wonnacott |
| D303,090 | S | 8/1989 | Armor et al. |
| 4,860,944 | A | 8/1989 | Wonnacott |
| 4,871,067 | A | 10/1989 | Valenti |
| 4,890,440 | A | 1/1990 | Romagnoli |
| 4,919,266 | A | 4/1990 | McIntosh, Jr. et al. |
| 4,949,845 | A | 8/1990 | Dixon |
| 4,966,324 | A | 10/1990 | Steel |
| 4,972,991 | A | 11/1990 | Schuster |
| 4,974,731 | A | 12/1990 | Wood |
| 4,974,771 | A | 12/1990 | Lavery |
| 4,981,253 | A | 1/1991 | Quaintance |
| 4,982,845 | A | 1/1991 | Prascak et al. |
| 4,989,778 | A | 2/1991 | Saulas |
| 5,002,186 | A | 3/1991 | Cooper |
| 5,031,825 | A | 7/1991 | Romangnoli |
| D321,134 | S | 10/1991 | Toinet |
| 5,067,615 | A | 11/1991 | Davitian |
| 5,072,876 | A | 12/1991 | Wilson |
| 5,101,642 | A | 4/1992 | Alexandrov |
| 5,106,014 | A | 4/1992 | Miller |
| 5,123,589 | A | 6/1992 | Cote |
| 5,137,211 | A | 8/1992 | Summer et al. |
| 5,143,252 | A | 9/1992 | Shi |
| 5,170,934 | A | 12/1992 | Lemoine |
| D332,915 | S | 2/1993 | Hoell et al. |
| 5,219,229 | A | 6/1993 | Sengewald |
| 5,249,681 | A | 10/1993 | Miller |
| 5,265,798 | A | 11/1993 | DeMaio et al. |
| 5,277,360 | A | 1/1994 | DeMott |
| 5,279,440 | A | 1/1994 | Fougeres et al. |
| 5,284,292 | A | 2/1994 | Johnson |
| 5,289,943 | A | 3/1994 | Powell |
| 5,292,059 | A | 3/1994 | Oliff |
| 5,297,725 | A | 3/1994 | Sutherland |
| 5,348,219 | A | 9/1994 | Brintazzoli |
| 5,368,194 | A | 11/1994 | Oliff et al. |
| 5,372,299 | A | 12/1994 | Edgerton, Jr. et al. |
| 5,385,234 | A | 1/1995 | Stout et al. |
| 5,425,474 | A | 6/1995 | Dalea et al. |
| 5,427,242 | A | 6/1995 | Oliff et al. |
| 5,437,407 | A | 8/1995 | Kim |
| 5,439,168 | A | 8/1995 | Kim |

(56) References Cited

U.S. PATENT DOCUMENTS

| | | | |
|---|---|---|---|
| 5,465,831 | A | 11/1995 | Smith |
| 5,482,185 | A | 1/1996 | McNaughton |
| 5,482,203 | A | 1/1996 | Stout |
| 5,505,372 | A | 4/1996 | Edson et al. |
| 5,518,111 | A | 5/1996 | Stout |
| 5,577,612 | A | 11/1996 | Chesson et al. |
| 5,597,114 | A | 1/1997 | Kramedjian et al. |
| 5,622,309 | A | 4/1997 | Matsuda et al. |
| D379,759 | S | 6/1997 | Mulry |
| 5,657,872 | A | 8/1997 | Leftwich et al. |
| 5,664,683 | A | 9/1997 | Brody |
| 5,682,984 | A | 11/1997 | Hoell et al. |
| 5,690,213 | A | 11/1997 | Matsumura |
| 5,699,957 | A | 12/1997 | Blin et al. |
| 5,722,584 | A | 3/1998 | Fujiwara |
| 5,772,030 | A | 6/1998 | Baxter |
| 5,775,574 | A | 7/1998 | Whitnell |
| 5,788,117 | A | 8/1998 | Zimmanck |
| 5,826,783 | A | 10/1998 | Stout |
| 5,833,118 | A | 11/1998 | Weiss |
| 5,857,614 | A | 1/1999 | Walsh |
| 5,873,515 | A | 2/1999 | Dunn et al. |
| 5,875,961 | A | 3/1999 | Stone et al. |
| 5,878,947 | A | 3/1999 | Hoy et al. |
| 5,881,884 | A | 3/1999 | Podosek |
| 5,921,398 | A | 7/1999 | Carroll |
| 5,924,559 | A | 7/1999 | Carrel et al. |
| 5,996,797 | A | 12/1999 | Flaig |
| 6,019,276 | A | 2/2000 | Auclair |
| 6,105,854 | A | 8/2000 | Spivey et al. |
| 6,105,856 | A | 8/2000 | Kakiuchi |
| 6,155,480 | A | 12/2000 | Botsford et al. |
| D436,859 | S | 1/2001 | Botsford et al. |
| 6,170,741 | B1 | 1/2001 | Skolik et al. |
| 6,176,419 | B1 | 1/2001 | Holley, Jr. |
| 6,209,786 | B1 | 4/2001 | Yelton et al. |
| 6,244,436 | B1 | 6/2001 | Boriani et al. |
| 6,253,930 | B1 | 7/2001 | Freidus et al. |
| 6,273,330 | B1 | 8/2001 | Oliff et al. |
| 6,283,293 | B1 | 9/2001 | Lingamfelter |
| D454,784 | S | 3/2002 | Oram |
| 6,386,369 | B2 | 5/2002 | Yuhas et al. |
| 6,386,438 | B1 | 5/2002 | Walsh et al. |
| 6,390,290 | B1 | 5/2002 | Focke et al. |
| 6,409,077 | B1 | 6/2002 | Telesca et al. |
| D459,927 | S | 7/2002 | Flowers et al. |
| 6,435,351 | B1 | 8/2002 | Gibb |
| 6,457,580 | B1 | 10/2002 | Focke et al. |
| 6,474,469 | B1 | 11/2002 | Luton et al. |
| 6,478,219 | B1 | 11/2002 | Holley, Jr. |
| 6,484,903 | B2 | 11/2002 | Spivey et al. |
| 6,550,615 | B2 | 4/2003 | Lingamfelter |
| 6,557,699 | B1 | 5/2003 | Focke et al. |
| 6,578,736 | B2 | 6/2003 | Spivey |
| 6,631,803 | B2 | 10/2003 | Rhodes et al. |
| 6,669,083 | B2 | 12/2003 | Bates |
| 6,715,639 | B2 | 4/2004 | Spivey |
| 6,752,262 | B1 | 6/2004 | Boriani et al. |
| 6,789,673 | B2 | 9/2004 | Lingamfelter |
| 6,866,185 | B2 | 3/2005 | Harrelson |
| 6,902,104 | B2 | 6/2005 | Holley, Jr. et al. |
| 6,918,487 | B2 | 7/2005 | Harrelson |
| 6,929,172 | B2 | 8/2005 | Bates et al. |
| 6,991,107 | B2 | 1/2006 | Harrelson |
| 6,997,316 | B2 | 2/2006 | Sutherland |
| 7,000,824 | B2 | 2/2006 | Saulas |
| 7,004,897 | B2 | 2/2006 | Spivey, Sr. |
| 7,048,817 | B1 | 5/2006 | Hammond |
| 7,100,798 | B2 | 9/2006 | Spivey |
| 7,104,435 | B2 | 9/2006 | Holley, Jr. |
| 7,134,551 | B2 | 11/2006 | Harrelson |
| 7,237,674 | B2 | 7/2007 | Auclair |
| 7,467,713 | B2 | 12/2008 | Harrelson |
| 7,614,497 | B2 | 11/2009 | Spivey, Sr. |
| 7,648,060 | B2 | 1/2010 | DeBusk |
| 7,780,003 | B2 | 8/2010 | Harrelson |
| 2002/0029991 | A1 | 3/2002 | Lingamfelter |
| 2002/0070139 | A1 | 6/2002 | Bates |
| 2002/0088820 | A1 | 7/2002 | Spivey |
| 2002/0088821 | A1 | 7/2002 | Spivey et al. |
| 2002/0185499 | A1 | 12/2002 | Harrelson et al. |
| 2002/0185527 | A1 | 12/2002 | Bates |
| 2003/0141313 | A1 | 7/2003 | Bates |
| 2003/0141353 | A1 | 7/2003 | Wilson |
| 2003/0150759 | A1 | 8/2003 | White |
| 2003/0192907 | A1 | 10/2003 | Bates |
| 2004/0060972 | A1 | 4/2004 | Harrelson |
| 2004/0089575 | A1 | 5/2004 | Lingamfelter |
| 2004/0089671 | A1 | 5/2004 | Miller |
| 2004/0099558 | A1 | 5/2004 | Oliff et al. |
| 2004/0155098 | A1 | 8/2004 | Harrelson |
| 2004/0188277 | A1 | 9/2004 | Auclair |
| 2004/0188300 | A1 | 9/2004 | Sutherland |
| 2004/0188508 | A1 | 9/2004 | Holley |
| 2005/0023170 | A1 | 2/2005 | Lingamfelter |
| 2005/0085364 | A1 | 4/2005 | Spivey |
| 2005/0092820 | A1 | 5/2005 | Chekroune |
| 2005/0126947 | A1 | 6/2005 | Holley |
| 2005/0178687 | A1 | 8/2005 | Spivey, Sr. |
| 2006/0175386 | A1 | 8/2006 | Holley |
| 2007/0017966 | A1 | 1/2007 | DeBusk et al. |
| 2007/0062834 | A1 | 3/2007 | Harrelson |

FOREIGN PATENT DOCUMENTS

| | | | |
|---|---|---|---|
| DE | 2 323 589 | | 11/1974 |
| DE | 75 10 538 | | 8/1975 |
| DE | 76 06 493 | U1 | 6/1976 |
| DE | 29 33 022 | | 9/1980 |
| DE | 30 07 769 | | 9/1981 |
| DE | 81 35 176 | | 5/1982 |
| DE | 8514718.4 | U1 | 6/1985 |
| DE | 86 29 664 | | 5/1987 |
| DE | 36 12 594 | | 10/1987 |
| DE | 40 23 043 | | 12/1991 |
| DE | 94 12 885 | | 10/1994 |
| DE | 94 13 813 | | 10/1994 |
| DE | 295 19 931 | | 2/1996 |
| DE | 296 02 010 | | 3/1996 |
| DE | 198 02 800 | | 7/1999 |
| DE | 29 909 008 | | 9/1999 |
| DE | 299 13 585 | | 10/1999 |
| DE | 694 21 620 | | 4/2000 |
| EP | 0 235 852 | | 9/1987 |
| EP | 0 323 596 | A1 | 7/1989 |
| EP | 0 342 088 | A1 | 11/1989 |
| EP | 0 475 147 | | 3/1992 |
| EP | 0 659 143 | | 6/1995 |
| EP | 0 752 370 | A2 | 1/1997 |
| EP | 0 849 189 | | 6/1998 |
| EP | 0 936 995 | | 8/1999 |
| EP | 1 038 783 | | 9/2000 |
| EP | 1 060 998 | | 12/2000 |
| EP | 1 615 839 | A2 | 1/2006 |
| FR | 2 549 010 | | 1/1985 |
| FR | 2683027 | A1 | 10/1993 |
| FR | 2 761 342 | A1 | 10/1998 |
| GB | 2 184 999 | A | 7/1987 |
| GB | 2 186 550 | A | 8/1987 |
| GB | 2 189 223 | A | 10/1987 |
| GB | 2 264 101 | | 8/1993 |
| JP | 49-18843-01 | | 2/1974 |
| JP | 55-61519 | | 5/1980 |
| JP | 59-147018 | A | 8/1984 |
| JP | 60-190680 | A | 9/1985 |
| JP | 63-111422 | A | 5/1988 |
| JP | 63-111422 | | 7/1988 |
| JP | 7-9721 | | 2/1995 |
| JP | 10-211924 | | 8/1998 |
| JP | 2000-50947 | A | 9/2001 |
| WO | WO 88/09750 | | 12/1988 |
| WO | WO 95/01284 | | 1/1995 |
| WO | WO 95/25668 | | 9/1995 |
| WO | WO-96/29260 | A1 | 9/1996 |

(56) References Cited

FOREIGN PATENT DOCUMENTS

| | | | |
|---|---|---|---|
| WO | WO 96/36538 | | 11/1996 |
| WO | WO 97/21607 | | 6/1997 |
| WO | WO 98/31593 | | 7/1998 |
| WO | WO 98/38099 | | 9/1998 |
| WO | WO-99/64301 | A1 | 12/1999 |
| WO | WO-00/03937 | A1 | 1/2000 |
| WO | WO 00/23334 | | 4/2000 |
| WO | WO-00/71428 | A1 | 11/2000 |
| WO | WO-01/28871 | A1 | 4/2001 |
| WO | WO 02/04302 | | 1/2002 |
| WO | WO-02/30785 | A1 | 4/2002 |
| WO | WO 02/085739 | | 10/2002 |
| WO | WO-2004/043790 | A2 | 5/2004 |
| WO | WO-2005/037663 | A1 | 4/2005 |
| WO | WO 2005/051777 | | 6/2005 |
| WO | WO 2005/051782 | | 6/2005 |

OTHER PUBLICATIONS

*Graphic Packaging International, Inc.* v. *C.W. Zumbiel Co.* (M.D. FL), Civil Action No. 3:10-cv-00891-UATC-JBT, Joint Final Pretrial Statement, Dec. 13, 2011.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion in Limine and Incorporated Memorandum of Law, Dec. 13, 2011.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Opposition to Defendant C.W. Zumbiel Co.'s Motion in Limine, Dec. 19, 2011.

*Graphic Packaging International, Inc.* v. *C.W. Zumbiel Co.* (M.D. FL), Civil Action No. 3:10-cv-00891-UATC-JBT, Transcript of Motion Hearing Before the Honorable Roy B. Dalton, Jr., U.S. District Judge, Dec. 18, 2011.

*Graphic Packaging International, Inc.* v. *C.W. Zumbiel Co.* (M.D. FL), Civil Action No. 3:10-cv-00891-UatcATC-JBT, Defendant C.W. Zumbiel Co.'s Opposition to Plaintiff Graphic Packaging International, Inc.'s Motion in Limine, Dec. 28, 2011.

*Graphic Packaging International, Inc.* v. *C.W. Zumbiel Co.* (M.D. FL), Civil Action No. 3:10-cv-00891-UATC-JBT, Order, Dec. 29, 2011.

*Graphic Packaging International, Inc.* v. *C.W. Zumbiel Co.* (M.D. FL), Civil Action No. 3:10-cv-00891-UATC-JBT, Parties' Replacement Sets of Joint and Disputed Proposed Jury Instructions, Jan. 2, 2012.

*Graphic Packaging International, Inc.* v. *C.W. Zumbiel Co.* (M.D. FL), Civil Action No. 3:10-cv-00891-UATC-JBT, Plaintiffs Revised Proposed Verdict Form, Jan. 2, 2012.

*Graphic Packaging International, Inc.* v. *C.W. Zumbiel Co.* (M.D. FL), Civil Action No. 3:10-cv-00891-UATC-JBT, Defendant's Revised Proposed Verdict Form, Jan. 3, 2012.

*Graphic Packaging International, Inc.* v. *C.W. Zumbiel Co.* (M.D. Fl), Civil Action No. 3:10-cv-00891-UATC-JBT, Order, Jan. 8, 2012.

*Graphic Packaging International, Inc.* v. *C.W. Zumbiel Co.* (M.D. FL), Civil Action No. 3:10-cv-00891-UATC-JBT, Plaintiffs Proposed Jury Instruction No. 16.5, Jan. 9, 2012.

*Graphic Packaging International, Inc.* v. *C.W. Zumbiel Co.* (M.D. FL), Civil Action No. 3:10-cv-00891-UATC-JBT, Parties' Revised and Augmented Joint and Disputed Proposed Jury Instructions, Jan. 12, 2012.

*Graphic Packaging International, Inc.* v. *C.W. Zumbiel Co.* (M.D. Fl), Civil Action No. 3:10-cv-00891-UATC-JBT, Agreed Curative Instructions Nos. 1 and 2, Jan. 12, 2012.

*Graphic Packaging International, Inc.* v. *C.W. Zumbiel Co.* (M.D. FL), Civil Action No. 3:10-cv-00891-UATC-JBT, Plaintiffs Corrected Proposed Verdict Form, Jan. 13, 2012.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion for Judgment as a Matter of Law and Incorporated Memorandum of Law, Jan. 19, 2012.

*Graphic Packaging International, Inc.* v. *C.W. Zumbiel Co.* (M.D. FL), Civil Action No. 3:10-cv-00891-UATC-JBT, Stipulated Facts, Jan. 19, 2012.

*Graphic Packaging International, Inc.* v. *C.W. Zumbiel Co.* (M.D. FL), Civil Action No. 3:10-cv-00891-UATC-JBT, Court's Instructions to the Jury, Jan. 19, 2012.

*Graphic Packaging International, Inc.* v. *C.W. Zumbiel Co.* (M.D. FL), Civil Action No. 3:10-cv-00891-UATC-JBT, Verdict Form, Jan. 19, 2012.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Unopposed Motion for Entry of Judgment on Jury Verdict and Incorporated Memorandum of Law, Jan. 23, 2012.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion for Leave to File Substitute Proposed Order, Jan. 24, 2012.

*Graphic Packaging International, Inc.* v. *C.W. Zumbiel Co.* (M.D. FL), Civil Action No. 3:10-cv-00891-UATC-JBT, Transcript of Jury Trial (vol. II) before The Honorable Judge Roy B. Dalton, Jr., United States District Judge, Jan. 26, 2012.

*Graphic Packaging International, Inc.* v. *C.W. Zumbiel Co.* (M.D. FL), Civil Action No. 3:10-cv-00891-UATC-JBT, Transcript of Jury Trial (vol. IV) before The Honorable Judge Roy B. Dalton, Jr., United States District Judge, Jan. 26, 2012.

*Graphic Packaging International, Inc.* v. *C.W. Zumbiel Co.* (M.D. FL), Civil Action No. 3:10-cv-00891-UATC-JBT, Transcript of Jury Trial (vol. VI) before The Honorable Judge Roy B. Dalton, Jr., United States District Judge, Jan. 26, 2012.

*Graphic Packaging International, Inc.* v. *C.W. Zumbiel Co.* (M.D. FL), Civil Action No. 3:10-cv-00891-UATC-JBT, vol. I, Afternoon Session, Excerpt Transcript of Jury Trial before The Honorable Judge Roy B. Dalton, Jr., United States District Judge, Jan. 26, 2012.

*Graphic Packaging International, Inc.* v. *C.W. Zumbiel Co.* (M.D. FL), Civil Action No. 3:10-cv-00891-UATC-JBT, vol. III, Afternoon Session, Transcript of Jury Trial before The Honorable Roy B. Dalton, Jr., U.S. District Judge, Jan. 26, 2012.

*Graphic Packaging International, Inc.* v. *C.W. Zumbiel Co.* (M.D. FL), Civil Action No. 3:10-cv-00891-UATC-JBT, vol. V, Afternoon Session, Transcript of Jury Trial before The Honorable Roy B. Dalton, Jr., U.S. District Judge, Jan. 26, 2012.

*Graphic Packaging International, Inc.* v. *C.W. Zumbiel Co.* (M.D. FL), Civil Action No. 3:10-cv-00891-UATC-JBT, vol. VII, Afternoon Session, Transcript of Jury Trial before The Honorable Roy B. Dalton, Jr., U.S. District Judge, Jan. 26, 2012.

*Graphic Packaging International, Inc.* v. *C.W. Zumbiel Co.* (M.D. FL), Civil Action No. 3:10-cv-00891-UATC-JBT, vol. VIII, Transcript of Jury Trial before The Honorable Roy B. Dalton, Jr., U.S. District Judge, Jan. 26, 2012.

*Graphic Packaging International, Inc.* v. *C.W. Zumbiel Co.* (M.D. FL), Civil Action No. 3:10-cv-00891-UATC-JBT, vol. IX, Transcript of Jury Trial before The Honorable Roy B. Dalton, Jr., U.S. District Judge, Jan. 26, 2012.

*Graphic Packaging International, Inc.* v. *C.W. Zumbiel Co.* (M.D. FL), Civil Action No. 3:10-cv-00891-UATC-JBT, vol. X, Transcript of Jury Trial before The Honorable Roy B. Dalton, Jr., U.S. District Judge, Jan. 26, 2012.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion for Preliminary Injunction and Incorporated Memorandum of Law, Jan. 27, 2012.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Renewed Motion for Judgment as a Matter of Law and Incorporated Memorandum of Law, Jan. 27, 2012.

*Graphic Packaging International, Inc.* v. *C.W. Zumbiel Co.* (M.D. FL), Civil Action No. 3:10-cv-00891-UATC-JBT, Order, Feb. 1, 2012.

*Graphic Packaging International, Inc.* v. *C.W. Zumbiel Co.* (M.D. FL), Civil Action No. 3:10-cv-00891-UATC-JBT, Amended Judgment in a Civil Case, Feb. 9, 2012.

(56) References Cited

OTHER PUBLICATIONS

*Graphic Packaging International, Inc.* v. *C.W. Zumbiel Co.* (M.D. FL), Civil Action No. 3:10-cv-00891-UATC-JBT, Defendant C.W. Zumbiel Co.'s Opposition to Plaintiff Graphic Packaging International, Inc.'s Renewed Motion for Judgment as a Matter of Law, Feb. 13, 2012.

*Graphic Packaging International, Inc.* v. *C.W. Zumbiel Co.* (M.D. FL), Civil Action No. 3:10-cv-00891-UATC-JBT, Defendant C.W. Zumbiel Co.'s Opposition to Plaintiff Graphic Packaging International, Inc.'s Motion for Permanent Injunction, Feb. 13, 2012.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion for Leave to File a Short Reply in Support of its Motion for Preliminary Injunction, Feb. 14, 2012.

*Graphic Packaging International, Inc.* v. *C.W. Zumbiel Co.* (M.D. FL), Civil Action No. 3:10-cv-00891-UATC-JBT, Order, Feb. 15, 2012.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Reply in Support of its Motion for Permanent Injunction, Feb. 17, 2012.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Renewed Motion for Judgment as a Matter of Law and Incorporated Memorandum of Law, Apr. 6, 2012.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion for Permanent Injunction and Incorporated Memorandum of Law, Apr. 6, 2012.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Reply in Support of Its Motion for Permanent Injunction, Apr. 6, 2012.

*Graphic Packaging International, Inc.* v. *C.W. Zumbiel Co.* (M.D. FL), Civil Action No. 3:10-cv-00891-UATC-JBT, Corrected Brief—Defendant C.W. Zumbiel Co.'s Opposition to Plaintiff Graphic Packaging International, Inc.'s Renewed Motion for Judgment as a Matter of Law, Apr. 12, 2012.

*Graphic Packaging International, Inc.* v. *C.W. Zumbiel Co.* (M.D. FL), Civil Action No. 3:10-cv-00891-UATC-JBT, Defendant C.W. Zumbiel Co.'s Opposition to Plaintiff Graphic Packaging International, Inc.'s Motion for Permanent Injunction, Apr. 12, 2012.

*Graphic Packaging International, Inc.* v. *C.W. Zumbiel Co.* (M.D. FL), Civil Action No. 3:10-cv-00891-UATC-JBT, Order [Granting Motion to Review Adopting Report and Recommendation], Jul. 16, 2012.

*Graphic Packaging International, Inc.* v. *C.W. Zumbiel Co.* (M.D. FL), Civil Action No. 3:10-cv-00891-UATC-JBT, Order [Denying Motion to Declare Case Exceptional], Jul. 16, 2012.

*Graphic Packaging International, Inc.* v. *C.W. Zumbiel Co.* (M.D. FL), Civil Action No. 3:10-cv-00891-UATC-JBT, Order [Granting Motion for Judgment as a Matter of Law], Jul. 16, 2012.

International Bottler & Packer, "Hot Hit With Consumers" published Nov. 2001.

Wall Street Journal; "Coke Bottler Tests a Slimmer Soda Package" published Aug. 10, 2001.

Beverage World; "Passing the Torch" published Oct. 2002.

Coca Cola Fridge Mate; "Revise Woolworth's Advertisement", WCA 4000/N1A.

Google translation of patent No. FR 2 761 342 to Sylvie.

Memorandum in Support of Conditional Motion to Stay Proceeding Pending Inter Partes Reexamination of U.S. Patent No. 6,789,673; filed Jan. 25, 2005 on behalf of Graphic Packaging International, Inc.; Civil Action No. 1-04-CV-0842 (JEC) (USDC N.D.GA); pp. 1 and 3.

Civil Docket for Case #: 3:10-cv-00891-UATC-JBT, *Graphic Packaging International, Inc.* v. *C.W. Zumbiel Co.*

*Graphic Packaging International, Inc.* v. *C.W. Zumbiel Co.* (M.D. FL), Civil Action No. 3:10-cv-00891-UATC-JBT, Complaint for Patent Infringement, Demand for Jury Trial and Injunctive Relief Sought, Sep. 29, 2010.

*Graphic Packaging International, Inc.* v. *C.W. Zumbiel Co.* (M.D. FL), Civil Action No. 3:10-cv-00891-UATC-JBT, Plaintiffs Motion for Preliminary Injunction and Request for Oral Argument, Oct. 25, 2010.

*Graphic Packaging International, Inc.* v. *C.W. Zumbiel Co.* (M.D. FL), Civil Action No. 3:10-cv-00891-UATC-JBT, Supporting Documents for Plaintiffs Motion for Preliminary Injunction and Request for Oral Argument.

*Graphic Packaging International, Inc.* v. *C.W. Zumbiel Co.* (M.D. FL), Civil Action No. 3:10-cv-00891-UATC-JBT, Defendant C.W. Zumbiel Co.'s Answer, Affirmative Defenses, and Counterclaim, Nov. 15, 2010.

*Graphic Packaging International, Inc.* v. *C.W. Zumbiel Co.* (M.D. FL), Civil Action No. 3:10-cv-00891-UATC-JBT, Defendant C.W. Zumbiel Co.'s Opposition to Plaintiffs Motion for Preliminary Injunction, Nov. 15, 2010.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion for Dismissal of Defendant C.W. Zumbiel Co.'s Counterclaim Pursuant to Federal Rule of Civil Procedure 12(b)(6) and Incorporated Memorandum of Law, Nov. 22, 2010.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion, and Incorporated Memorandum of Law, to Strike Defendant C.W. Zumbiel Co.'s Second, Third, Sixth, and Seventh Affirmative Defenses, Nov. 22, 2010.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Verified Reply to Defendant C.W. Zumbiel Co.'s Counterclaim for Declaratory Judgment, Nov. 23, 2010.

*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Emergency Motion for Leave to Supplement Preliminary Injunction Motion Record with Newly-Generated Evidentiary Items, Nov. 29, 2010.

*Graphic Packaging International, Inc.* v. *C.W. Zumbiel Co.* (M.D. FL), Civil Action No. 3:10-cv-00891-UATC-JBT, Defendant C.W. Zumbiel Co.'s Opposition to Plaintiffs Emergency Motion for Leave to Supplement Preliminary Injunction Motion, Nov. 30, 2010.

*Graphic Packaging International, Inc.* v. *C.W. Zumbiel Co.* (M.D. FL), Civil Action No. 3:10-cv-00891-UATC-JBT, Defendant C.W. Zumbiel Co.'s Opposition to Plaintiffs Motion for Dismissal of Zumbiel's Counterclaim Pursuant to Federal Rule of Civil Procedure 12(b)(6), Dec. 9, 2010.

*Graphic Packaging International, Inc.* v. *C.W. Zumbiel Co.* (M.D. FL), Civil Action No. 3:10-cv-00891-UATC-JBT, Defendant C.W. Zumbiel Co.'s Opposition to Plaintiffs Motion to Strike Zumbiel's Second, Third, Sixth, and Seventh Affirmative Defenses, Dec. 9, 2010.

*Graphic Packaging International, Inc.* v. *C.W. Zumbiel Co.* (M.D. FL), Civil Action No. 3:10-cv-00891-UATC-JBT, Defendant C.W. Zumbiel Co.'s Unopposed Motion for Leave to File an Amended Answer, Affirmative Defenses, and Counterclaim under Fed.R.Civ.P. 15(a)(2) and Incorporated Memorandum of Law, Dec. 9, 2010.

*Graphic Packaging International, Inc.* v. *C.W. Zumbiel Co.* (M.D. FL), Civil Action No. 3:10-cv-00891-UATC-JBT, GPI's Supplemental Preliminary Injunction Brief, Dec. 15, 2010.

*Graphic Packaging International, Inc.* v. *C.W. Zumbiel Co.* (M.D. FL), Civil Action No. 3:10-cv-00891-UATC-JBT, Defendant C.W. Zumbiel Co.'s Sur-Reply to Plaintiffs Supplemental Preliminary Injunction Brief, Jan. 6, 2010.

*Graphic Packaging International, Inc.* v. *C.W. Zumbiel Co.* (M.D. FL), Civil Action No. 3:10-cv-00891-UATC-JBT, Dec. 1, 2010 Motion Hearing Before the Honorable Timothy J. Corrigan, United States District Judge, Jan. 31, 2011.

(56) References Cited

OTHER PUBLICATIONS

*Graphic Packaging International, Inc.* v. *C.W. Zumbiel Co.* (M.D. FL), Civil Action No. 3:10-cv-00891-UATC-JBT, Order, Feb. 4, 2011.
*Graphic Packaging International, Inc.* v. *C.W. Zumbiel Co.* (M.D. FL), Civil Action No. 3:10-cv-00891-UATC-JBT, Defendant C.W. Zumbiel Co.' Opening Claim Construction Brief, Feb. 7, 2011.
*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Opening Claim Construction Brief, Feb. 7, 2011.
*Graphic Packaging International, Inc.* v. *C.W. Zumbiel Co.* (M.D. FL), Civil Action No. 3:10-cv-00891-UATC-JBT, Defendant C.W. Zumbiel Co.'s Responsive Claim Construction Brief, Feb. 21, 2011.
*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Responsive Claim Construction Brief, Feb. 21, 2011.
*Graphic Packaging International, Inc.* v. *C.W. Zumbiel Co.* (M.D. FL), Civil Action No. 3:10-cv-00891-UATC-JBT, Defendant C.W. Zumbiel's Identification of Prior Art, Mar. 11, 2011.
*Graphic Packaging International, Inc.* v. *C.W. Zumbiel Co.* (M.D. FL), Civil Action No. 3:10-cv-00891-UATC-JBT, Markman Hearing and Preliminary Pretrial Conference Before the Honorable Timothy J. Corrigan United States District Judge, Mar. 23, 2011.
*Graphic Packaging International, Inc.* v. *C.W. Zumbiel Co.* (M.D. FL), Civil Action No. 3:10-cv-00891-UATC-JBT, Order, Mar. 28, 2011.
*Graphic Packaging International, Inc.* v. *C.W. Zumbiel Co.* (M.D. FL), Civil Action No. 3:10-cv-00891-UATC-JBT, Defendant C.W. Zumbiel Co.'s Amended Answer, Affirmative Defenses, and Counterclaim, Dec. 9, 2010.
*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion to Dismiss Defendant C.W. Zumbiel Co.'s Amended Counterclaim and Incorporated Memorandum of Law, Apr. 13, 2011.
*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion to Strike Defendant C.W. Zumbiel Co.'s Second, Third, Sixth, and Seventh Affirmative Defenses and Portions of the Amended Counterclaim and Incorporated Memorandum of Law, Apr. 13, 2011.
*Graphic Packaging International, Inc.* v. *C.W. Zumbiel Co.* (M.D. FL), Civil Action No. 3:10-cv-00891-UATC-JBT, Order, Apr. 18, 2011.
*Graphic Packaging International, Inc.* v. *C.W. Zumbiel Co.* (M.D. FL), Civil Action No. 3:10-cv-00891-UATC-JBT, Defendant C.W. Zumbiel Co.'s Opposition to Plaintiffs Motion to Dismiss Defendant C.W. Zumbiel Co.'s Amended Counterclaim and Incorporated Memorandum of Law, Apr. 27, 2011.
*Graphic Packaging International, Inc.* v. *C.W. Zumbiel Co.* (M.D. FL), Civil Action No. 3:10-cv-00891-UATC-JBT, Defendant C.W. Zumbiel Co.'s Opposition to Plaintiff Graphic Packaging International Inc.'s Motion to Strike Zumbiel's Second, Third, Six, and Seventh Affirmative Defenses, Apr. 27, 2011.
*Graphic Packaging International, Inc.* v. *C.W. Zumbiel Co.* (M.D. FL), Civil Action No. 3:10-cv-00891-UATC-JBT, Order, Sep. 12, 2011.
*Graphic Packaging International, Inc.* v. *C.W. Zumbiel Co.* (M.D. FL), Civil Action No. 3:10-cv-00891-UATC-JBT, Plaintiffs Motion to Strike Portions of the Supplemental Expert report of Dr. Robert M. Kimmel Relying on Prior Art not Identified by Defendant, Sep. 12, 2011.
*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Reply to Defendant C.W. Zumbiel Co.'s Amended Counterclaim, Sep. 26, 2011.
*Graphic Packaging International, Inc.* v. *C.W. Zumbiel Co.* (M.D. FL), Civil Action No. 3:10-cv-00891-UATC-JBT, Zumbiel's Opposition to Plaintiff Graphic Packaging International Inc.'s Motion to Strike Portions of the Supplemental Expert Report of Dr. Robert M. Kimmel, Sep. 26, 2011.
*Graphic Packaging International, Inc.* v. *C.W. Zumbiel Co.* (M.D. FL), Civil Action No. 3:10-cv-00891-UATC-JBT, Defendant C.W. Zumbiel Co.'s Motion for Summary Judgment and Accompanying Memorandum in Support, Oct. 3, 2011.
*Graphic Packaging International, Inc.* v. *C.W. Zumbiel Co.* (M.D. FL), Civil Action No. 3:10-cv-00891-UATC-JBT, Defendant C.W. Zumbiel Co.'s *Daubert* Motion, Oct. 3, 2011.
*Graphic Packaging International, Inc.* v. *C.W. Zumbiel Co.* (M.D. FL), Civil Action No. 3:10-cv-00891-UATC-JBT, Plaintiff Graphic Packaging International, Inc.'s *Daubert* Motion to Exclude Certain Expert Testimony of Dr. Robert M. Kimmel and Incorporated Memorandum of Law, Oct. 3, 2011.
*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Opposition to Defendant C.W. Zumbiel Co.'s *Daubert* Motion, Oct. 20, 2011.
*Graphic Packaging International, Inc.* v. *C.W. Zumbiel Co.* (M.D. FL), Civil Action No. 3:10-cv-00891-UATC-JBT, Defendant C.W. Zumbiel Co.'s Opposition to Plaintiff Graphic Packaging International, Inc.'s *Daubert* Motion to Exclude Certain Expert Testimony of Dr. Robert M. Kimmel, Oct. 20, 2011.
*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion to Exclude Miller Publication and Toe Saver Carton and Incorporated Memorandum of Law, Nov. 1, 2011.
*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Opposition to Defendant C.W. Zumbiel Co.'s Motion for Summary Judgment, Nov. 2, 2011.
*Graphic Packaging International, Inc.* v. *C.W. Zumbiel Co.* (M.D. FL), Civil Action No. 3:10-cv-00891-UATC-JBT, Defendant C.W. Zumbiel Co.'s Opposition to Plaintiff Graphic Packaging International, Inc.'s Motion for Partial Summary Judgment, Nov. 2, 2011.
*Graphic Packaging International, Inc.* v. *C.W. Zumbiel Co.* (M.D. FL), Civil Action No. 3:10-cv-00891-UATC-JBT, Order, Nov. 3, 2011.
*Graphic Packaging International, Inc.* v. *C.W. Zumbiel Co.* (M.D. FL), Civil Action No. 3:10-cv-00891-UATC-JBT, Zumbiel's Opposition to Plaintiff Graphic Packaging International Inc.'s Motion to Exclude Miller Publication and Toe Saver Carton and Incorporated Memorandum of Law, Nov. 16, 2011.
*Graphic Packaging International, Inc.* v. *C.W. Zumbiel Co.* (M.D. FL), Civil Action No. 3:10-cv-00891-UATC-JBT, Reply Memorandum of Plaintiff Graphic Packaging International, Inc. in Support of its Motion for Partial Summary Judgment, Nov. 16, 2011.
*Graphic Packaging International, Inc.* v. *C.W. Zumbiel Co.* (M.D. FL), Civil Action No. 3:10-cv-00891-UATC-JBT, Defendant C.W. Zumbiel Co.'s Reply in Support of its Motion for Summary Judgment, Nov. 16, 2011.
*Graphic Packaging International, Inc.* v. *C.W. Zumbiel Co.* (M.D. FL), Civil Action No. 3:10-cv-00891-UATC-JBT, Plaintiff Graphic Packaging International, Inc.'s Motion for Partial Summary Judgment and Incorporated Memorandum of Law, Oct. 3, 2011.
Reexamination Control No. 95/001,796, Request for Inter Partes Reexamination—Replacement Document, dated Dec. 6, 2011.
Reexamination Control No. 95/001,796, Order Granting/Denying Request for Inter Partes Reexamination, dated Jan. 17, 2012.
Reexamination Control No. 95/001,796, Office Action in Inter Partes Reexamination, dated Jan. 17, 2012.
Reexamination Control No. 95/001,796, Petition to Withdraw Office Action, dated Jan. 31, 2012.
Reexamination Control No. 95/001,796, Decision on Patent Owner's Petition under 37 CFR 1.181, dated Feb. 10, 2012.
Reexamination Control No. 95/001,796, Order Granting/Denying Request for Inter Partes Reexamination, dated Feb. 10, 2012.
Reexamination Control No. 95/001,796, Office Action in Inter Partes Reexamination, dated Feb. 10, 2012.

(56) References Cited

OTHER PUBLICATIONS

Reexamination Control No. 95/001,796, Petition to Suspend Reexamination Proceeding, dated Feb. 17, 2012.
Reexamination Control No. 95/001,796, Third Party Requester's Opposition to Patent Owner's Petition to Suspend Reexamination Proceeding, dated Feb. 23, 2012.
Reexamination Control No. 95/001,796, Reply to Requester's Opposition to Patent Owner's Petition to Suspend Reexamination Proceeding, dated Feb. 29, 2012.
Reexamination Control No. 95/001,796, Patent Owner's Request for Extension of Time to File Response to Office Action, dated Mar. 30, 2012.
Reexamination Control No. 95/001,796, Decision on Petition for Extension of Time in Reexamination, dated Apr. 4, 2012.
Reexamination Control No. 95/001,796, Patent Owner's Second Request for Extension of Time to File Response to Office Action, dated May 1, 2012.
Reexamination Control No. 95/001,796, Decision on Petition for Extension of Time in Reexamination, dated May 3, 2012.
Reexamination Control No. 95/001,796, Patent Owner's Third Request for Extension of Time to File Response to Office Action, dated Jun. 7, 2012.
Reexamination Control No. 95/001,796, Decision on Petition for Extension of Time in Reexamination, dated Jun. 7, 2012.
Reexamination Control No. 95/001,796, Response to Office Action, dated Jun. 25, 2012.

DISPENSING SYSTEM FOR DOUBLE STACK CARTON

CROSS-REFERENCE TO RELATED APPLICATION

This application is a continuation of co-pending U.S. patent application Ser. No. 13/455,259, filed Apr. 25, 2012, which is a continuation of U.S. patent application Ser. No. 13/052,489, filed Mar. 21, 2011, now U.S. Pat. No. 8,181,782, which is a continuation of U.S. patent application Ser. No. 12/752,586, filed Apr. 1, 2010, now U.S. Pat. No. 8,127,924, which is a continuation of U.S. patent application Ser. No. 12/274,477, filed Nov. 20, 2008, now U.S. Pat. No. 7,780, 003, which is a continuation of U.S. patent application Ser. No. 11/558,717, filed Nov. 10, 2006, now U.S. Pat. No. 7,467, 713, which is a continuation of U.S. patent application Ser. No. 11/139,827, filed May 27, 2005, now U.S. Pat. No. 7,134, 551, which is a continuation of U.S. patent application Ser. No. 10/365,148, filed Feb. 12, 2003, now U.S. Pat. No. 6,918, 487.

INCORPORATION BY REFERENCE

The disclosures of U.S. patent application Ser. No. 13/455, 259, filed Apr. 25, 2012, U.S. patent application Ser. No. 13/052,489, filed Mar. 21, 2011, U.S. patent application Ser. No. 12/752,586, filed Apr. 1, 2010, U.S. patent application Ser. No. 12/274,477, filed Nov. 20, 2008, U.S. patent application Ser. No. 11/558,717, filed Nov. 10, 2006, U.S. patent application Ser. No. 11/139,827, filed May 27, 2005, U.S. patent application Ser. No. 10/365,148, filed Feb. 12, 2003, are hereby incorporated by reference as if presented herein in their entirety.

BACKGROUND OF THE INVENTION

1. Field of the Invention

The present invention relates generally to an enclosed paperboard carton capable of enclosing containers in two tiers, which carton has a unique opening and dispensing feature that allows the containers, for example, cans, to be removed or dispensed one container per tier at a time without destroying the overall structural integrity of the carton. The unique opening and dispensing feature can be incorporated in cartons containing a plurality of layers of containers stacked on end and still limit the dispensing to one container per tier at a time.

2. Background

Fully enclosed cartons capable of enclosing cans have been used in the past that have a feature for dispensing the cans one at a time. Dispensers have been provided at various locations on these cartons depending on the design.

Cartons have been introduced into the marketplace that can carry 24 or more containers, for example cans, in two stacks or tiers. So far no satisfactory dispenser has been developed for dispensing the layers of cans in these two stack cartons one at a time from each stack or tier. Consequently, when these cartons are opened they tend to let a number of the cans roll out which has not allowed these twin stack cartons to achieve their full potential.

3. Prior Art

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the side walls to permit grasping of the can to withdraw it from the carton. When the flap is opened, the cans are held in the carton by an arcuate flap portion extending downwardly in the end wall into the center of the aperture. The structural integrity of this carton is compromised because the entire bottom end of the carton is opened. It will be realized that the design of this dispenser is not satisfactory for dispensing containers, for example cans, that are stacked in twin stacks in a carton.

U.S. Pat. No. 4,364,509 to Holly, Jr. et al. also discloses a fully enclosed carton with a dispenser in one of the end walls. This dispenser is likewise formed in the end wall by tearing out an end flap and lowering it into proper position. Expansion slits are provided in the side wall for the user's fingers to grasp the ends of the existing can. The dispenser of this carton is not satisfactory for use in a twin stack carton for carrying containers.

SUMMARY OF THE INVENTION

It is an object of this invention to develop a dispenser for dispensing containers, for example cans, one at a time from a carton containing containers in two stacks or tiers. It is the further object of this invention to develop a dispenser that can be easily opened. A further object of this invention is to develop a dispenser that can be used for containers stacked in a 3 by 4 configuration in each stack to be dispensed one at a time from each stack without the containers rolling out accidentally. A final object of this invention is to develop a dispenser for a twin stack carton that does not destroy the structural integrity of the carton when it is opened.

Briefly described, in its preferred form, the objects of this invention are achieved by providing an enclosed carton for carrying containers in two tiers for dispensing the containers one at a time from each tier from the exiting end of the carton. The carton is generally rectangular and has a bottom, top, two sides, a closed end and exiting end. The carton is foldably constructed from a blank having panels and flaps. The carton is designed to carry containers, e.g. cans, that are stacked on their ends in two tiers from the bottom panel to the top panel. The dispenser is constructed by providing tear lines in one of the side panels that extend into the exiting end of the carton which is rested on the other side panel, with the dispenser being capable of dispensing the containers as they are resting on their sides. A tear line is provided in the end of the carton placed from the side upon which the carton rests while dispensing containers at a sufficient distance to prevent any of the containers below the top layer of containers from rolling out of the carton when the dispenser is open. A pair of tear lines extend from this bottom tear line from each end at an angle from the bottom tear line to the top side panel in which part of the dispenser is formed. The angle and distance of the projection is such as to restrain the top layer of cans in each tier from accidentally rolling out. The dispenser is constructed with a large enough opening in. the top side panel in which it is formed to permit a person to grasp and remove a container in each tier one at a time.

This carton can be designed with a dispenser dispensing containers in a 3 by 4 configuration in each tier. The bottom tear line is located so as to prevent the bottom layers of containers from rolling out of the carton. A pair of tear lines extending from the ends of the bottom tear line are placed at an angle designed to restrain containers in the top layer from rolling out of the carton.

Because a carton for carrying 24 containers is placed under a great deal of stress, the top panel can be constructed from two handle flaps having a reinforcing strip attached to the inside handle flap folded over against the inside of the carton between the two oval handle apertures carrying the carton.

To facilitate holding the containers and dispensing them one at a time a divider may be provided between each tier of containers.

To facilitate opening the carton dispenser, a pull tab can be provided in the side panel where part of the dispenser is located, with the pull tab being loosely attached to the panel, but tightly attached to the dispenser for opening the dispenser.

Preferably the exiting end of the carton has four flaps for closing this end. An end flap attached to the side of the carton on which it is resting while the containers are being dispensed is generally not removed and serves to restrain one or more of the bottom layers of containers from rolling out of the carton. Preferably the tear lines in the end flaps attached to the top panel, and bottom panel are constructed so that a portion of each of these flaps is not removed and are glued to the flap attached to the side panel on which the carton rests during dispensing to preserve the integrity of the carton.

Other objects, features and advantages of this invention will become apparent upon reading the following specification, when taken in conjunction with the accompanying drawings.

DETAILED DESCRIPTION OF THE PREFERRED EMBODIMENTS

Figure 1:
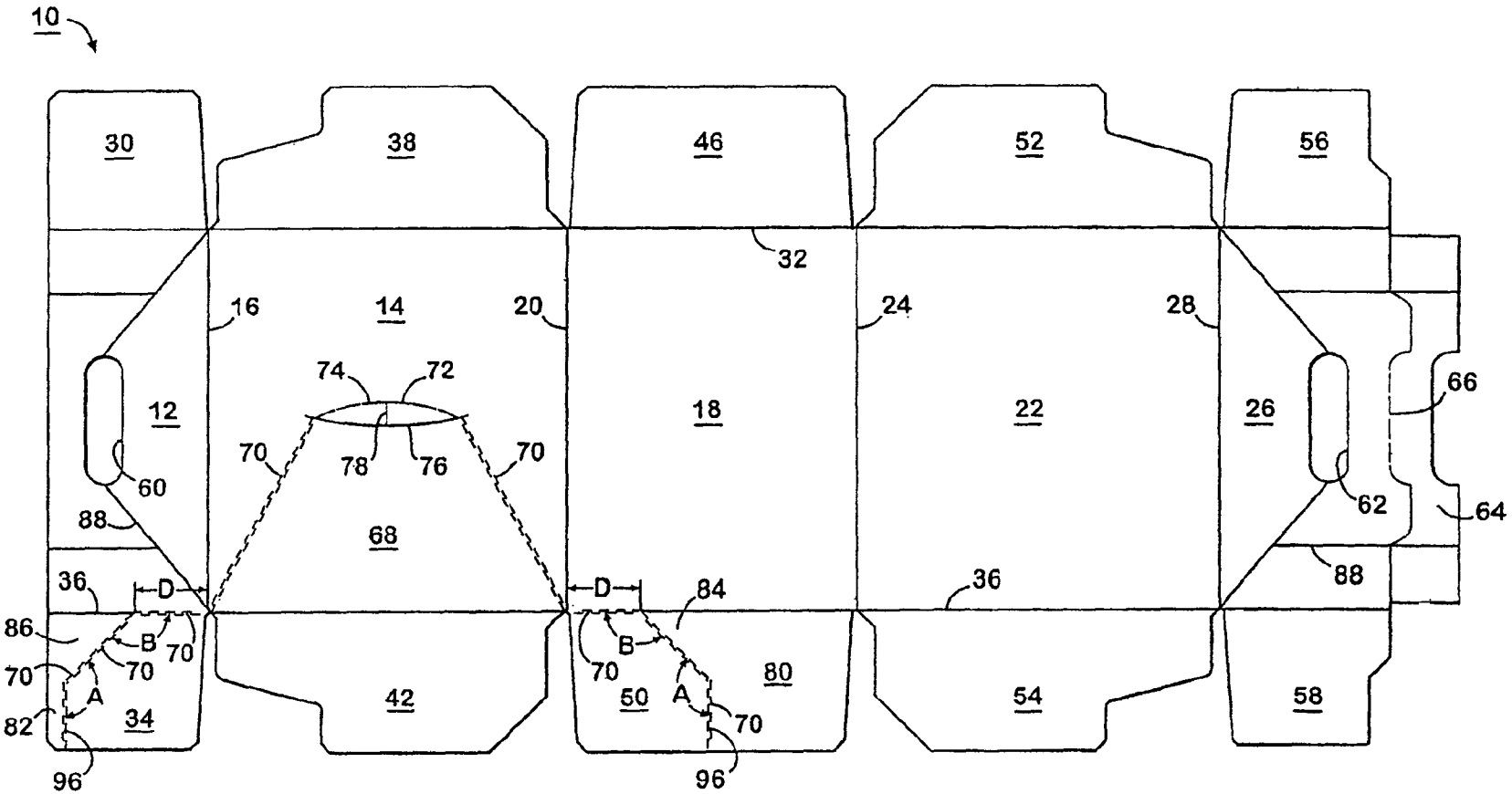
FIG. 1 is a plan view of the blank of the preferred embodiment of this invention from which a carton is formed.

The present invention is intended primarily for use with cans of the types used to contain soft drinks, beer and the like. The blank 10 is formed from a foldable sheet of material, such a paperboard. The blank 10 has an outside handle flap 12 which is attached to the top side panel 14 by fold line 16 which in turn is attached to bottom panel 18 by fold line 20, which in turn is attached to bottom side panel 22 by fold line 24. Bottom side panel 22 is foldably attached to inside handle flap 26 by fold line 28. The carton is supplied with a number of end flaps for closing the ends of the carton. The outside handle flap 12 is attached to outside top end flap 30 by fold line 32 and outside handle flap 12 is attached to outside top end flap 34 by fold line 36. Top side flap 38 is attached to top side panel 14 by fold line 32. Top side panel 14 is attached to top side flap 42 by fold line 36. Bottom panel 18 is attached to bottom end flap 46 by fold line 32 and to bottom end flap 50 by fold line 36. Bottom side panel 22 is attached to bottom side flap 52 by fold line 32 and to bottom side flap 54 by fold line 36. Inside handle flap 26 is attached to inside top end flap 56 by fold line 32 and to the inside top end flap 58 by fold line 36.

This carton has a pair of race track handles 60 and 62 formed in outside handle flap 12 and inside handle flap 26 respectively. Because this carton is designed to carry 24 containers, such as cans, it is provided with a handle reinforcing flap 64 attached to inside handle flap 26 by fold line 66.

A dispensing flap 68 is partially formed in top side panel 14 by tear line 70. To facilitate opening this dispenser, a pull tab 72 is provided to facilitate opening the dispensing flap 68. The pull tab 72 is loosely attached to top side panel 14. Pull tab 72 has a slit 74 between it and top side panel 14 to ease pulling of the pull tab from the plane of top side panel 14. Pull tab 72 is attached to dispensing flap 68 by fold line 76. A slit 78 may be provided in the middle of pull tab 72 to ease its removal from top side panel 14.

It will be understood by those skilled in the art that the carton of the present invention is generally symmetrical about a horizontal line of bisection, as viewed when FIG. 1 is rotated lengthwise. This symmetry aids in the efficient production of the present carton.

Figure 7:
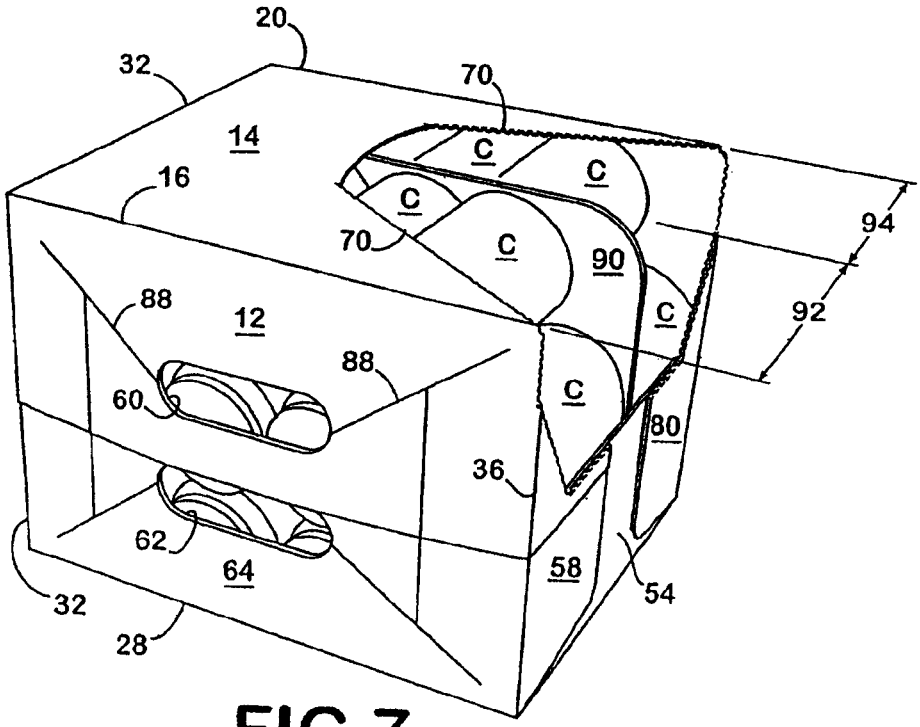
FIG. 7 is a perspective end view of the carton of FIG. 6 showing that a can has been removed from the top tier and from the bottom tier of cans.

In forming this blank 10 into a carton, the handle reinforcing flap 64 is folded along fold line 66 and glued to the inside handle flap 26. The blank 10 is then folded so that outside handle flap 12 is glued to inside handle flap 26 so that the two oval handles 60 and 62 are parallel to each other. These steps result in forming a carton sleeve in which cans can be loaded in the bottling plant. The cans can be placed in two tiers of a 3 by 4 configuration. This is best illustrated in FIG. 7 which shows the top tier 92 located near the top of the carton and the bottom tier 94 located near the bottom of the carton. In order to maintain the two tiers of cans in proper alignment during loading and when dispensed to the consumer, a divider 90 may be necessary. The divider 90 can be made out of a single sheet of paperboard.

After the two tiers of cans have been loaded into the carton various end flaps on both ends are closed and glued. To use the end of the carton where the dispenser is located as an example, the top side flap 42 is folded inwardly, bottom side flap 54 is folded inwardly, bottom end flap 50 is folded in an overlapping position, and glued to top side flap 42 and bottom side flap 54. Outside top end flap 34 and inside top end flap 58 are glued together to form a single top end flap which is likewise glued to top side flap 42 and bottom side flap 54. The other end of the carton is closed in the same manner.

When the dispenser is opened, dispensing flap 68, which includes top side flap 42, is removed from the carton along with a portion of outside end flap 34 and bottom end flap 50 along tear line 70. In order to preserve the structural integrity of the carton after the dispenser has been opened, it is important that end retention panel 82 be glued to inside top end flap 58 which in turn is glued to bottom side flap 54. Otherwise, the end retention projection 86 will not be firmly attached to carton. It is likewise important that end retention panel 80 be glued to bottom side flap 54 in order to ensure that end retention projection 84 is firmly attached to the carton after the dispenser is opened.

It should be realized that dispensers could be placed on both ends of the carton, but preferably it is only placed on one end. Cans can be removed from the exiting end of the carton after tear line 70 has been torn. The pair of tear lines 70 converge towards each other towards pull tab 72. Tear line 70 extends along fold line 36 between bottom end flap 50 and bottom, or second, panel 18 for a distance D and turns at an angle B and turns again at angle A to form a portion of bottom tear line 96. On the other side of top side, or first, panel 14, tear line 70 extends to fold line 36 and extends along that line and turns into the interior of outside top end flap 34 at angle B until it turns to form bottom line 96 at angle A.

Figure 2:
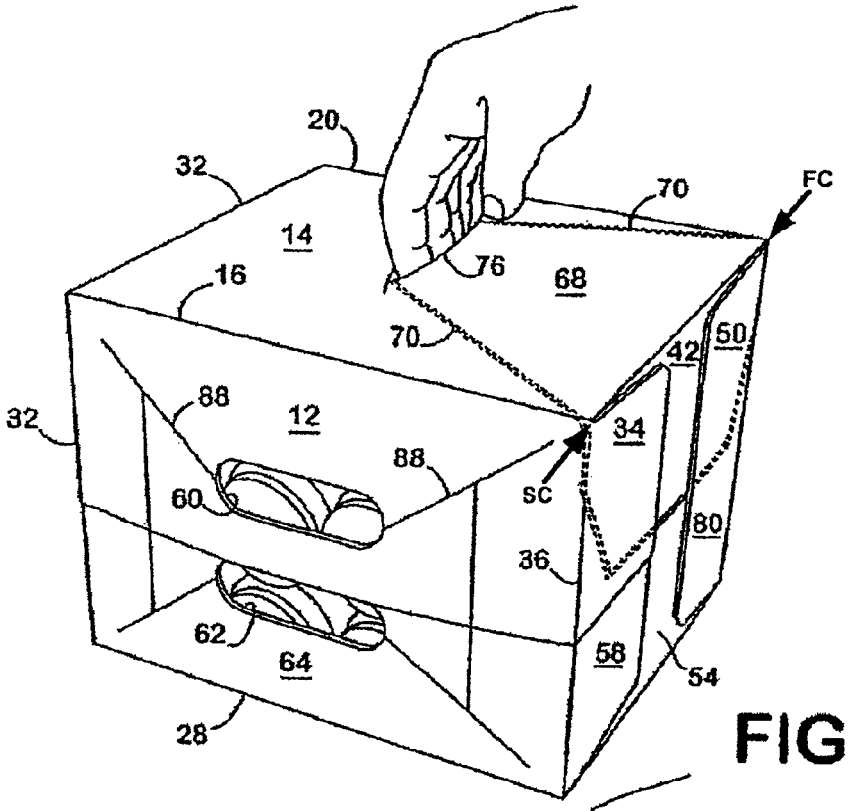
FIG. 2 is a perspective top view of the carton of the preferred embodiment loaded with two tiers of cans in a 3 by 4 configuration in each tier with a person starting to open the dispenser.
Figure 3:
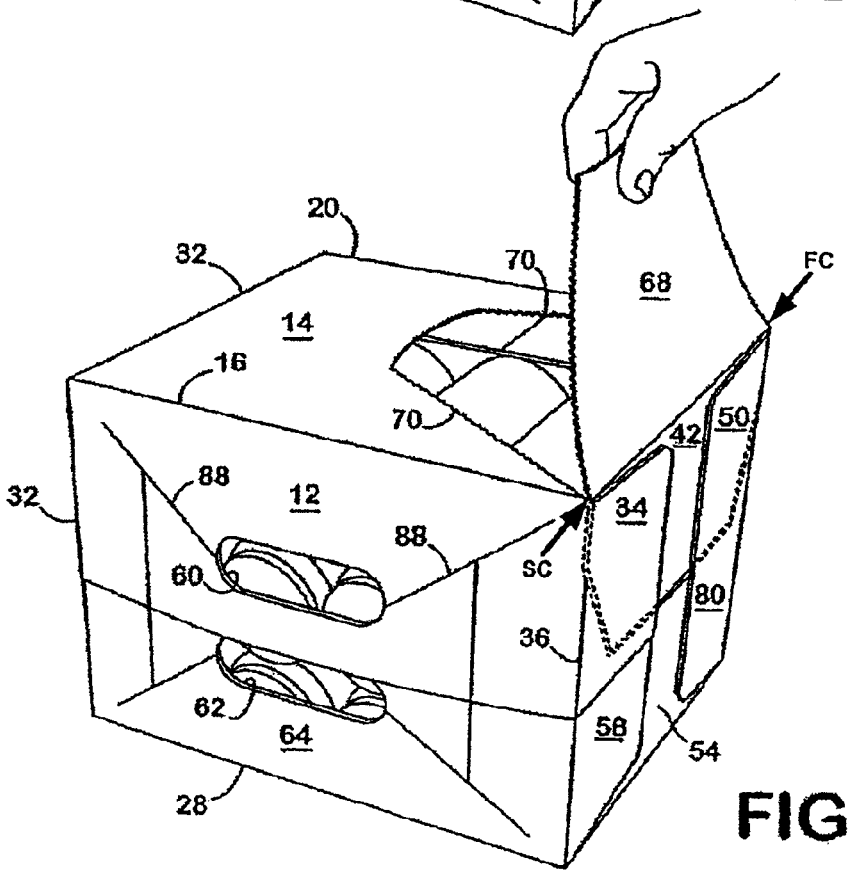
FIG. 3 is a perspective top view of the carton with a dispenser pulled part way open.
Figure 4:
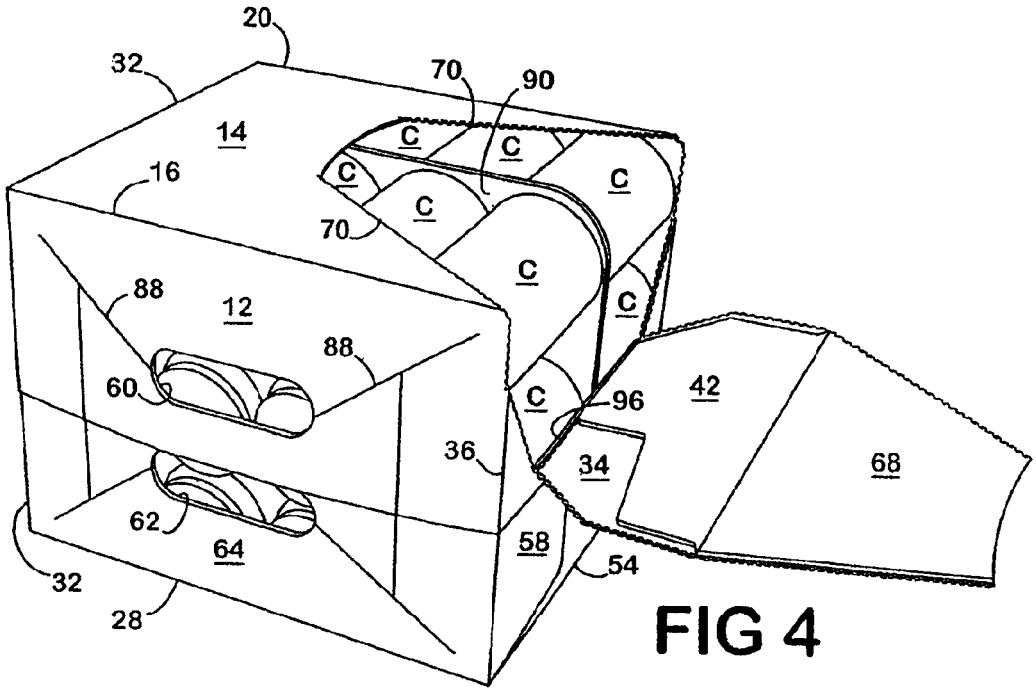
FIG. 4 is a perspective end view of the carton with cans in each tier in a 3 by 4 configuration with the dispenser being opened except for the bottom tear line.
Figure 5:
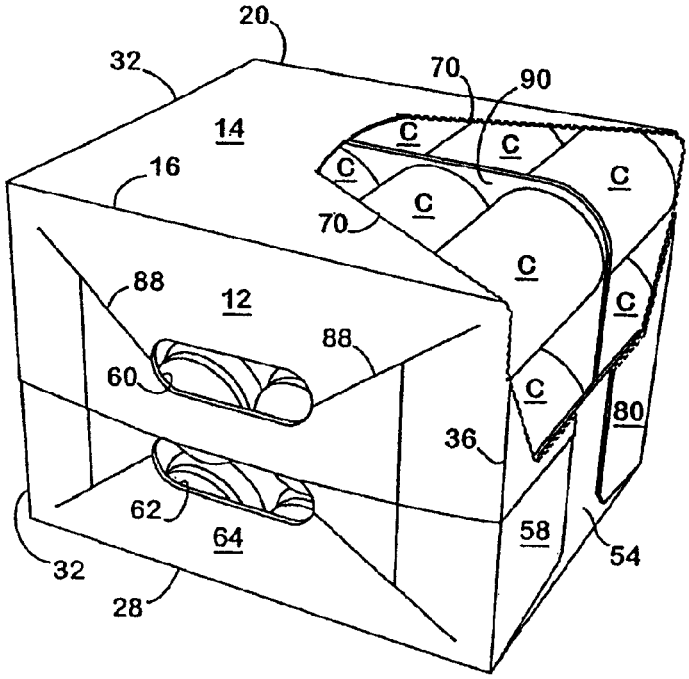
FIG. 5 is perspective end view of the carton loaded with two tiers of cans in a 3 by 4 configuration with the dispenser completely removed but all the cans being contained in the carton.

The consumer can open dispensing flap 68 by inserting his or her fingers into pull tab 72 which is an easy maneuver because of slit 74. In place of slit 74, a tear line that is loosely attached to top side panel 14 may be substituted in lieu of the slit. Insertion of the fingers into the aperture formed by depressing pull tab 72 is illustrated in FIG. 2. It will be noticed that the carton has been turned 90° so that it rests on bottom side, or fourth, panel 22. Outside handle flap 12 and inside handle flap 26 form the top, or third, panel. As shown in FIGS. 2-3, the first panel 14, second panel 18, and the exiting end meet at a first corner FC, and the first panel 14, third panel 12, 26, and the exiting end meet at a second corner SC. As shown in FIGS. 2-7, one of the pair of tear lines 70 that converge towards each other extends from the first corner FC into first panel 14 and the other of the pair of tear lines 70 that converge towards each other extends from the second corner SC into first panel 14. The consumer proceeds to pull pull tab 72 upward which is connected by fold line 76 to dispensing flap 68 which is pulled up as illustrated in FIG. 3. Continued tearing open of the dispenser is illustrated in FIG. 4. The dispenser is opened along tear line 70 which extends on both sides so that the dispensing flap 68 is torn open along fold line 36 and into the interior of outside top end flap 34 and bottom end flap 50 as illustrated in FIG. 4. The tearing continues down to the point where tear line 70 forms bottom tear line 96 which has not yet been torn as shown in FIG. 4. FIG. 5 illustrates a complete removal of the dispenser by tearing along bottom tear line 96. Even though the entire dispenser has been removed in FIG. 5, the cans are retained in the carton even though the cans are lying on their sides. The bottom two layers of cans in the 3 by 4 configuration are prevented from rolling out of the carton by bottom side flap 54 to which end retention panels 80 and 82 are glued. It will be noticed that bottom side flap 54 only extends part way up the diameter of the cans in the second layer of the three tiers. The top layer of cans in the two tiers is prevented from rolling out by end retention projections 84 and 86. Tear line 70 only extends along fold line 36 a distance D which is slightly less than the diameter of the top layer of cans being contained. This is sufficient to prevent the top layer of cans from rolling out of the carton but yet not prevent an obstacle to their easy removal by the consumer. Tear line 70 turns at an angle B and then turns again at angle A to form the bottom tear line 96 on both outside top end flap 34 and bottom end flap 50. It will be realized that end retention projections 84 and 86 are helpful in retaining the top layer of cans in the carton. The extent of this help depends upon the location of the bottom tear line 96 in relation to the layers of cans C.

Figure 6:
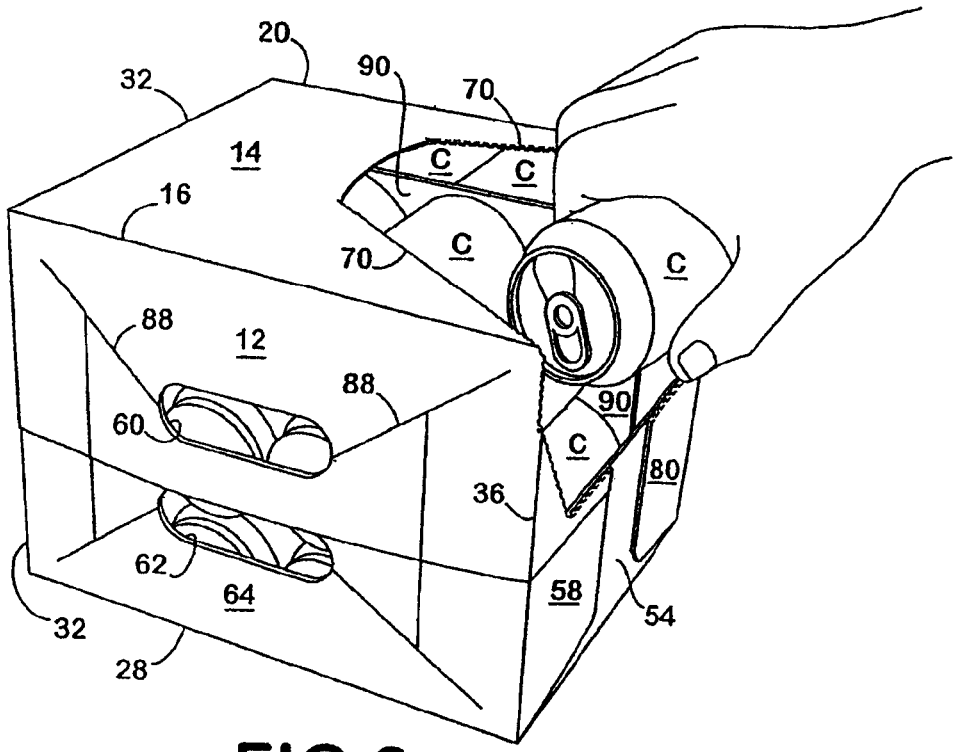
FIG. 6 is a perspective end of the carton of FIG. 5 showing a person removing a can from the top tier of cans.

FIG. 6 illustrates a consumer removing a can from the top tier 92 of cans C. It will be noticed that the consumer moves a can by twisting it slightly along its longitudinal axis and removing the bottom end of the can C first as it easily slides along the divider 90. It is necessary to remove the can in this way as the top of the can is retained in position by end retention projection 86. The end retention projections 84 and 86 are important as it is desirable that the cans in the top layer not roll out when the dispenser is open. The divider 90 and end retention projections 84 and 86 are designed to ensure that the top layer of cans adjacent the dispenser not roll out accidentally. FIG. 7 illustrates a carton with cans from each tier having been removed with the remaining cans held in place.

Because the blank 10 is designed to carry 24 cans in two tiers, it will be appreciated that the carton is heavy when loaded with cans. It is preferred that the top panel be composed of an outside handle flap 12 and an inside handle flap 26 and handle reinforcing flap 64 be utilized. In addition, stress lines 88 that are designed to dissipate the stress posed by lifting the carton handle 60 and 62 can be utilized. It should be realized that the carton sleeves can be glued together at other locations but is preferred to be glued at the top panel.

It will be noticed that the tear lines 70 in top side panel 14 converge towards each other and extend away from fold line 36 to provide a large enough opening when dispensing flap 68 is removed to permit a person to grasp cans in the top layer in each tier near the exiting end of the carton.

A carton for carrying cans is preferred that these containers have ends that are of the same diameter as the body of the container.

UNIQUE FEATURES OF THE DISPENSER OF THIS INVENTION

One of the unique features of the dispenser of this invention is that it permits the easy dispensing of containers that are stacked in two tiers. The carton is unique in that it carries the containers in their upright position, but dispenses them when the containers are on their side. Placement of the bottom tear line in the dispenser will restrain all but the top layer of containers from rolling out. An angled projection on each side of the dispenser can be utilized to prevent the top layer of containers from rolling out. The provision of a divider is important in maintaining the configuration of the containers into two tiers during loading and dispensing.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A method of dispensing containers, the method comprising:

providing a carton having four panels, a closed end, and an exiting end; the four panels including a first panel connected between a second panel and a third panel, and including a fourth panel opposite the first panel; the fourth panel connected between the second panel and the third panel; the carton enclosing cylindrical containers, each of the containers having a side and an axis; the carton including a tear line in the first panel and in the exiting end; the tear line defining a dispensing flap in the first panel and in the exiting end; the tear line in the exiting end extending at least partially along and collinear with a fold line connecting the exiting end to the second panel; the tear line dividing the dispensing flap from a remainder portion of the exiting end;

resting the fourth panel of the carton on a surface to dispose the first panel at a top of the carton over the containers; the axes of the containers in the carton being parallel to the first panel and parallel to the exiting end; and forming an opening by separating the dispensing flap at least partially along the tear line in the first panel and at least partially along the tear line in the exiting end; wherein the separating of the dispensing flap in the exiting end at least partially separates the dispensing flap from the remainder portion; the opening permitting removal of said containers from the carton; the remainder portion preventing the containers from rolling out of the carton.

2. The method of claim 1, wherein the carton further includes a handle in the first panel.

3. The method of claim 1, wherein formation of the opening is initiated at the first panel.

4. The method of claim 1, wherein a pull tab is provided in the first panel to initiate opening.

5. The method of claim 1, wherein the dispensing flap can remain attached to the carton when the opening is formed.

6. The method of claim 1, wherein the dispensing flap can be entirely removed from the carton.

7. The method of claim 1, wherein the exiting end is formed of end flaps connected to the first, second, third and fourth panels.

8. The method of claim 1, wherein the tear line extends at least partially along and collinear with a second fold line that connects the exiting end to the third panel.

9. The method of claim 1, wherein the carton is made from paperboard.

10. The method of claim 1, wherein structural integrity of the carton is maintained after the opening is formed.

11. The method of claim 1, wherein a finger flap assists separating the dispensing flap.

12. The method of claim 11, wherein the finger flap is disposed in the first panel.

13. The method of claim 1, wherein the containers are cans.

14. A method of dispensing comprising:

providing a carton having four panels, a closed end, and an exiting end; the four panels including a first panel, a second panel, a third panel, and a fourth panel; the first panel being connected between the second panel and the third panel; the first panel being opposite the fourth panel; the fourth panel being disposed between the second panel and the third panel; the carton enclosing a plurality of containers including a first container contacting the first panel and the exiting end; the first container having an axis; the carton including a tear line in the first panel and in the exiting end; the tear line in the exiting end extending at least partially along and collinear with a fold line connecting the exiting end to the second panel;

placing the carton on the fourth panel with the first panel being disposed on a top of the carton; the axis of the first container being perpendicular to the second panel, perpendicular to the third panel, parallel the first panel, and parallel the exiting end; and forming an opening in the exiting end of the carton by separating a dispensing flap from a remainder portion; the remainder portion being in the exiting end; the remainder portion preventing the containers from rolling out of the carton and the opening permitting removal of the containers.

15. The method of claim 14, wherein the carton further includes a handle in the first panel.

16. The method of claim 14, wherein formation of the opening is initiated at the first panel.

17. The method of claim 14, wherein a pull tab is provided in the first panel to initiate opening.

18. The method of claim 14, wherein the dispensing flap can remain attached to the carton when the opening is formed.

19. The method of claim 14, wherein the dispensing flap can be entirely removed from the carton.

20. The method of claim 14, wherein the exiting end is formed of end flaps connected to the first, second, third and fourth panels.

21. The method of claim 14, wherein the tear line extends at least partially along and collinear with a second fold line that connects the exiting end to the third panel.

22. The method of claim 14, wherein the carton is made from paperboard.

23. The method of claim 14, wherein structural integrity of the carton is maintained after the opening is formed.

24. The method of claim 14, wherein a finger flap assists separating the dispensing flap.

25. The method of claim 24, wherein the finger flap is disposed in the first panel.

26. The method of claim 14, wherein the containers are cans.

* * * * *